US008193935B2

(12) United States Patent
Gates

(10) Patent No.: US 8,193,935 B2
(45) Date of Patent: Jun. 5, 2012

(54) RFID PERIMETER ALARM MONITORING SYSTEM

(76) Inventor: Tell A. Gates, Falls Church, VA (US)

( * ) Notice: Subject to any disclaimer, the term of this patent is extended or adjusted under 35 U.S.C. 154(b) by 591 days.

(21) Appl. No.: 11/284,002

(22) Filed: Nov. 22, 2005

(65) Prior Publication Data

US 2007/0194914 A1 Aug. 23, 2007

(51) Int. Cl.
*G08B 13/08* (2006.01)

(52) U.S. Cl. ..... 340/545.1; 340/539.22; 340/572.8; 340/693.1

(58) Field of Classification Search ..... 340/573.1, 340/541, 10.1, 10.32, 10.41, 1, 539.1, 539.22, 340/540, 545.1, 545.2, 545.5, 545.6, 686.1, 340/542, 572.1–572.9
See application file for complete search history.

(56) References Cited

U.S. PATENT DOCUMENTS 4,367,458 A * 1/1983 Hackett ..... 340/539.16
6,025,783 A * 2/2000 Steffens, Jr. ..... 340/644
6,369,712 B2 * 4/2002 Letkomiller et al. ..... 340/572.1
6,400,272 B1 6/2002 Holtzman
6,577,238 B1 6/2003 Whitesmith
6,720,866 B1 * 4/2004 Sorrells et al. ..... 340/10.4
6,888,459 B2 * 5/2005 Stilp ..... 340/541
7,019,639 B2 * 3/2006 Stilp ..... 340/531
7,023,341 B2 4/2006 Stilp
7,057,512 B2 * 6/2006 Stilp ..... 340/572.1
7,079,028 B2 * 7/2006 Herrmann et al. ..... 340/541
7,079,034 B2 * 7/2006 Stilp ..... 340/573.1
7,081,815 B2 * 7/2006 Runyon et al. ..... 340/541
7,084,756 B2 8/2006 Stilp
7,202,788 B2 * 4/2007 Shieh et al. ..... 340/572.1
7,259,674 B2 * 8/2007 Marsilio et al. ..... 340/572.1
7,298,274 B2 * 11/2007 Chen et al. ..... 340/572.8
2004/0150521 A1 8/2004 Stilp
2004/0160309 A1 8/2004 Stilp
2004/0160322 A1 8/2004 Stilp
2004/0160323 A1 8/2004 Stilp
2004/0212493 A1 10/2004 Stilp
2004/0212500 A1 10/2004 Stilp
2004/0212503 A1 10/2004 Stilp
2006/0132302 A1 6/2006 Stilp
2006/0132303 A1 6/2006 Stilp

* cited by examiner

*Primary Examiner* — Thomas Mullen
(74) *Attorney, Agent, or Firm* — Dan Fiul

(57) ABSTRACT

An RFID based security system detects a lock/unlocked condition when securing a premise and an open/close condition of a window and/or door to monitor for an intruder. A local interface polls a RFID tag and relays a read value to a user panel for a determination if an intruder has opened a window and/or door. Alternately, the local interface is connected to at least one of a second local interface and the user panel to form a security network. The security network is relied on to convey security information to the user panel for a determination if an intruder has opened a window and/or door.

25 Claims, 7 Drawing Sheets

RFID PERIMETER ALARM MONITORING SYSTEM

BACKGROUND OF THE INVENTION

1. Field of the Invention

This invention relates generally to security systems. More particularly, it relates to a Radio Frequency Identification (RFID) based security system.

2. Background

Security systems are becoming increasingly commonplace, especially within homes. In particular, security systems based on wired sensors and wireless sensors relying on batteries are used to detect intrusions within homes and businesses.

FIG. 6 shows a conventional wired security system 601 based on wired sensors throughout a home or business attached to a central control center controlled by a remote user panel.

In particular, FIG. 6 shows a conventional wired security system 601 comprising a wired door sensor 610, a door 615, a wired window sensor 620, a window 625, a wired motion sensor 630, a wired central control center 640, a wired remote user panel 650 and a speaker 670.

A conventional wired security system 601 is configured in a hub and spoke topology. The remote user panel 650 acts as a hub to all of the spokes within the system comprising the wired door sensor 610, the wired window sensor 620, the wired motion sensor 630 and the wired remote user panel 650.

The wired remote user panel 650 is used to activate and deactivate the conventional wired security system 601. Moreover, the wired remote user panel 650 provides visual indication of the status of the conventional wireless security system 601, such as activation status, individual zone status, etc.

The wired central control center 640 constantly monitors the output of: the wired door sensor 610, attached to door 615, the wired window sensor 620, attached to window 625, and the wired motion sensor 630. If any of the wired door sensor 610, the wired window sensor 620, and the wired motion sensor 630 detect an intrusion within an associated zone, the wired central control center 640 activates the speaker 670 to audibly alert occupants of a building being monitored by the wired central control center 640 of a possible intrusion.

The drawback of a conventional wired security system 601 is the need to pre-wire the system, i.e., during construction of a building or post-wire the system, i.e., after construction of a building. Post-wiring a conventional wired security system 601 potentially runs into such issues as access to open walls to run wires, less than optimal placement of sensors due to limitations created by installation issues, time, cost, the need to hire a professional installer, etc.

FIG. 7 shows a conventional wireless security system 601 based on wireless sensors throughout a premises wirelessly connected to a central control center controlled by a remote user panel.

In particular, FIG. 7 shows a conventional wireless security system 601 comprising a wireless door sensor 710, a door 715, a wireless window sensor 720, a window 725, a wireless motion sensor 730, a wireless remote user panel 750 and a speaker 770.

As can be seen from FIG. 7, a conventional wireless security system 601 typically does away with a central control center, with the wireless remote user panel 750 incorporating features found in a wired central control center.

The wireless remote user panel 750, typically located near a doorway, is used to activate and deactivate the conventional wireless security system 601. Moreover, the wireless remote user panel 750 provides visual indication of the status of the conventional wireless security system 601, such as activation status, individual zone status, etc.

The wireless remote user panel 750 constantly monitors the output of: the wireless door sensor 710, attached to door 715, the wireless window sensor 720, attached to window 725, and the wireless motion sensor 730. If any of the wireless door sensor 710, the wireless window sensor 720 and the wireless motion sensor 730 detect an intrusion within an associated zone, the wireless remote user panel 750 activates the speaker 770 to audibly alert occupants of a building being monitored by the wireless remote user panel 750 of a possible intrusion.

The drawback of a conventional wireless security system 601 is the need to replace batteries within the system, i.e., a battery within the wireless door sensor 710, a battery within the wireless window sensor 720, a battery within the wireless motion sensor 730, and a battery within the wireless remote user panel 750. A dead battery within a large premises having a large number of wireless window sensors 720 and wireless motion sensors 730 can leave a significant portion of a building unprotected in the event of an intrusion. Even worse, a dead battery within the wireless remote user panel 750 completely disables the conventional wireless security system 601. Moreover, a dead battery within a large premises having a large number of windows can result in significant time and effort expended to periodically change out batteries, typically once a year to ensure all batteries within the system are powered.

As a result of the drawbacks cited above for both conventional wired and wireless security systems 601, there is a need for apparatus and methods which allow security systems to be more easily installed than with a wired home security system and without a wireless security system's reliance on battery powered sensors.

SUMMARY OF THE INVENTION

In accordance with the principles of the present invention, a security system comprises a passive sensor to detect an open/close condition and a wireless local interface to wirelessly poll the passive sensor for a binary value respectively associated with an open/close condition.

A method of surveying a premises for an intruder comprises passively detecting an open/close condition and wirelessly polling the passive sensor for a binary value respectively associated with an open/close condition with a wireless local interface.

A method of surveying a premises for an intruder comprises detecting a motion within a field of view of a first local interface and wirelessly communicating the detected motion over a security network to a second local interface.

BRIEF DESCRIPTION OF THE DRAWINGS

Features and advantages of the present invention will become apparent to those skilled in the art from the following description with reference to the drawings, in which.

DETAILED DESCRIPTION OF ILLUSTRATIVE EMBODIMENTS

The present invention provides a RFID Perimeter Alarm Monitoring System (RPAM) that relies on wireless security sensors that lack a battery or other power source to monitor for an intrusion within a home (e.g., door sensors and/or window sensors). In accordance with the principles of the present invention, electrical outlet/phone outlet monitors check the status of RFID sensors and relay any possible intrusions to a remote user panel for activation of a user alert.

The RPAM provides a system and method to monitor windows and doors without retrofitting a building's wiring. The RPAM eliminates a requirement of annual replacement of batteries at each door and/or window sensor within the system.

With the RPAM, no battery, compartment, and cover is required. As a result of a lack of battery, compartment and cover, the size of the door sensors and/or window sensors can be made extremely small. This allows the door sensors and window sensors to be embedded in the window latch or the door lock, thereby improving the ease and aesthetics of the installation.

Figure 1:
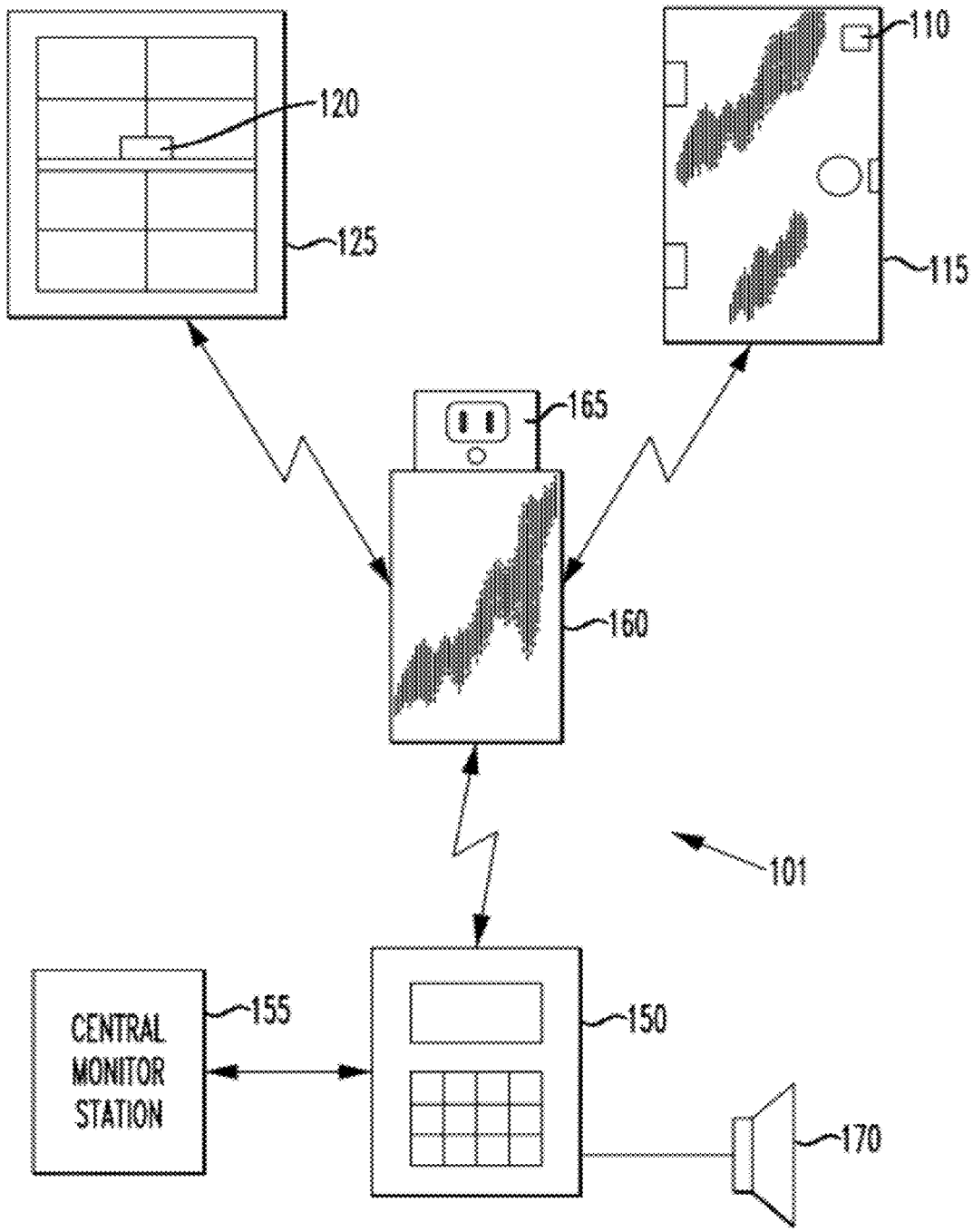
FIG. 1 shows an overview of a wireless home security system relying on RFID sensors, in accordance with the principles of the present invention.

FIG. 1 shows a system level view of the RPAM 101, in accordance with the principles of the present invention.

In particular, as shown in FIG. 1, the RPAM 101 is comprised of a wireless window sensor 120, a window 125, a wireless door sensor 110, a door 115, a wireless local interface 160, a conventional wall outlet 165, a remote user panel 150, a central monitoring station 155 and a speaker 170.

A single wireless window sensor 120, a single wireless door sensor 110, a single wireless local interface 160, and a single user panel 150 are show in FIG. 1 for simplification of illustration only. Within an actual implementation of the RPAM 101 in accordance with the principles of the present invention, the number of wireless window sensors 120, wireless door sensors 115, wireless local interfaces 160 and user panels 150 is unlimited, i.e., based on the size and configuration of the premises being monitored.

The wireless window sensor 120 is illustrated as being incorporated in a lock mechanism of window 125. To simplify incorporation of a wireless window sensor 120 into a window 125 at the time of manufacture and to retrofit a premises with a wireless door sensor 120 in accordance with the invention, the wireless window sensor 120 can be manufactured to fit within a conventional window lock housing. A spring loaded magnetic switch, a mechanical switch, or similar switch, activates a change in bit value in an RFID tag embedded in the wireless window sensor 120 to signal a possible intrusion within a premises being monitored by the RPAM 101.

The wireless door sensor 110 is illustrated as being incorporated in a door 115. To sense an opening of door 115, a second portion of the wireless door sensor 110 is incorporated into a door frame, not shown. To simplify incorporation of a wireless door sensor 110 into a door 115 at the time of manufacture and to retrofit a premises with a wireless door sensor 110 in accordance with the invention, the wireless door sensor 110 can be manufactured to fit within a conventional door lock housing. A spring loaded magnetic switch, a mechanical switch, or similar switch activates a change in bit value in an RFID tag embedded in the wireless door sensor 110 to signal a possible intrusion within a premises being monitored by the RPAM 101.

Moreover, the wireless window sensor 120 and wireless door sensor 110 can be used to detect whether their respective associated window 125 and door 115 latch/lock mechanisms are latched/locked. A mechanical switch activates a change in bit value in an RFID tag embedded in the wireless window sensor 120 and wireless door sensor 110 to signal a change in latch/lock value. In this manner, the RPAM can be used to determine if windows and/or doors within a building being monitored are latched/locked in addition to monitoring if window 125 and/or door 115 has been opened.

The wireless local interface 160 conveniently plugs into a conventional wall outlet 165 for power. A polling signal is emitted from the wireless local interface 160 to read a value of an RFID embedded in the wireless window sensor 120 and the wireless door sensor 110. The RFID value read from the wireless window sensor 120 and the wireless door sensor 110 is transmitted to the remote user panel 150.

The remote user panel 150 receives the RFID value transmitted from the wireless local interface 160. The RFID value is compared to a previously stored RFID value. If the RFID value is different than a previously stored RFID value, the speaker 170 is activated to alert a user of a potential intruder within a premises being monitored by the RPAM 101. Optionally, the central monitoring center 155 is called through a telephone interface to alert local police of a possible intrusion. Such central monitoring service is an optional paid service that is not required to operate the RPAM 101 as a deterrent to an intruder entering a premises with speaker 170 sounding an alarm.

The remote user panel 150 is used to activate and deactivate the RPAM 101. Moreover, the user panel 150 provides visual indication of the status of the RPAM 101, such as activation status, individual zone status, etc.

During initial setup of the RPAM 101, all of the RFID sensors within the RPAM 101 are polled for storage of baseline values of the RFID sensors within the RPAM 101. The baseline RFID values are constantly compared to RFID values polled from wireless window sensor 120 and the wireless door sensor 110 for a determination of a change in value indicating opening of a latch/lock mechanism and a possible intrusion.

As discussed above, a single wireless window sensor 120, a single wireless door sensor 110, a single wireless local interface 160, and a single user panel 150 are show in FIG. 1 for simplification of illustration only. During an implementation of the RPAM 101, multiple addresses in the wireless local interfaces 160 emulate, as well as differentiate zone types, such as a door open delay area vs. an instant alarm window opening detected.

Figure 2:
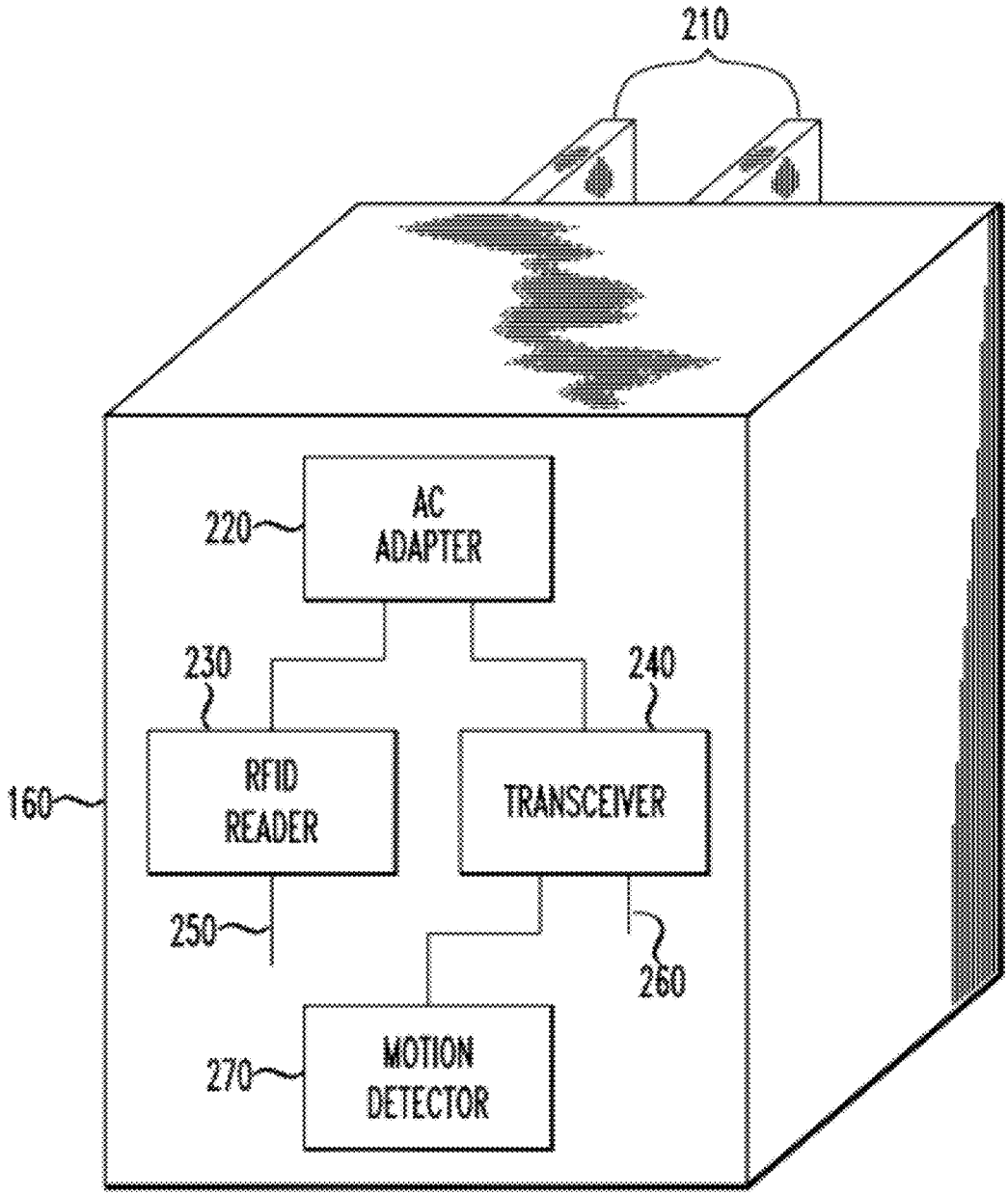
FIG. 2 shows a detailed view of the wireless local interface from FIG. 1, in accordance with the principles of the present invention.

FIG. 2 shows a detailed view of the wireless local interface 160 as shown in FIG. 1, in accordance with the principles of the present invention.

In particular, the wireless local interface 160 is comprised of electrical outlet connectors 210, an AC adapter 220, an RFID reader 230, a transceiver 240, an RFID antenna 250 and a transceiver antenna 260.

The electrical outlet connectors 210 allow the wireless local interface 160 to receive power from the standard wall outlet 165 shown in FIG. 1.

A polling signal is emitted from the wireless local interface 160 by the RFID reader to read a value of an RFID embedded in the wireless window sensor 120 and the wireless door sensor 110 through antenna 250. The RFID value read from the wireless window sensor 120 and the wireless door sensor 110 changes if the window 125 and/or door 115 has been opened by an intruder.

Transceiver 240 is connected to RFID reader 230. The RFID values polled from the wireless window sensor 120 and the wireless door sensor 110 are received from the RFID reader 230 for transmission to the remote user panel 150 through transceiver antenna 260.

Optionally, wireless local interface 160 comprises motion detector 270. The motion detector 270 provides backup intrusion detection in the event that an intruder is able to gain access to a premises without opening window 125 and door 115, and in the event that the wireless window sensor 120 and the wireless door sensor 110 become inoperable.

The communications path between the wireless local interface 160 and the remote user panel 150 can utilize any wired or wireless technology, such as X10 power line communications, Bluetooth, etc. The system is optionally compatible with conventional wireless security systems at the interface of the transceiver 240 in the wireless local interface 160.

Figure 3:
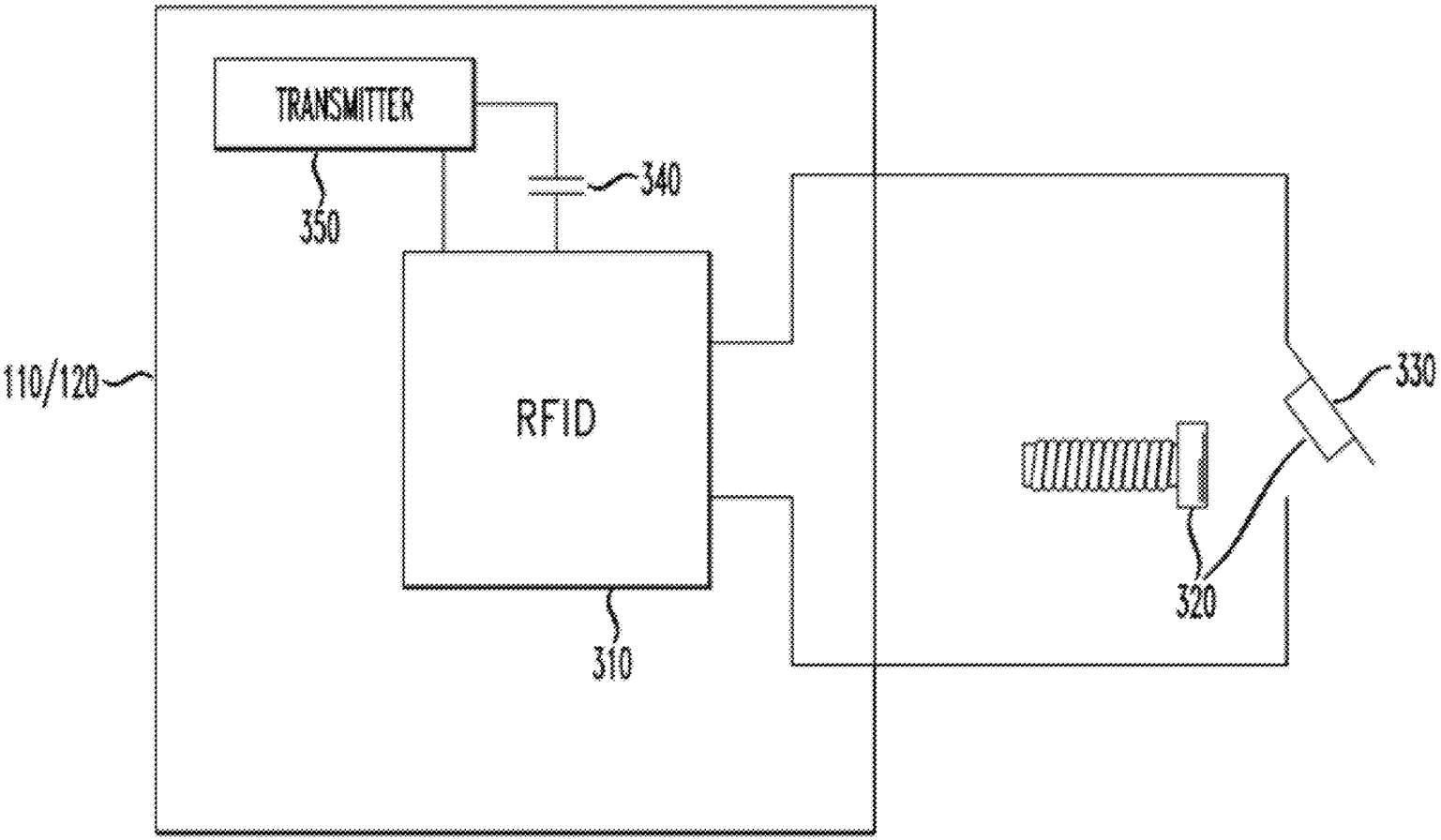
FIG. 3 shows a detailed view of the sensors used in the wireless window sensor and the wireless door sensor from FIG. 1, in accordance with the principles of the present invention.

Although the exemplary wireless local interface 160 show in FIG. 3 is shown as being plugged into the conventional wall outlet 165 for power, for a more aesthetic installation the wireless local interface is incorporate into a wall power outlet and/or a telephone line outlet. From all appearances, the wireless local interface would therefore be indistinguishable from a conventional wall power outlet and/or a telephone line outlet. This arrangement has the advantage of disguising the zones being covered by the RPAM 101 from an intruder and at the same time freeing an outlet for conventional use of two plug-in devices for power and/or a plug-in for a telephone.

Moreover, RFID antenna 250, transceiver antenna 260 and an antenna within the remote user panel 150 can be directional antennas for optimizing communications within the RPAM 101. A directional antenna's orientation can be adjusted to maximize a communication signal's strength and associated distances between components within the RPAM 101. In this manner, obstruction from such obstacles as other electronics, power lines, pipes, etc. can be minimized.

FIG. 3 shows a detailed view of the battery-less sensors, i.e., sensors lacking any type of power supply, used in the wireless window sensor 120 and the wireless door sensor 110 from FIG. 1, in accordance with the principles of the present invention.

In particular, the wireless window sensor 120 and the wireless door sensor 110 comprise an RFID tag 310, a wireless sensor switch 330, a magnetic spring actuator 320, a wireless sensor capacitor, a wireless sensor transmitter 350.

During operation, the RFID tag 310 is continuously monitored for a determination of a change in value that equates to a possible intrusion. The magnetic spring actuator 320 opens and closes the wireless sensor switch 330 according to an opening and closing of the window 125 and door 115. The open and close position of the wireless sensor switch 330 changes a bit value produced by the RFID tag 310. The bit value produced by the RFID tag 310 is compared to a previously stored RFID value during initialization of the RPAM 101. In this manner, the RFID tag 310 allows a determination of the opening and closing of the window 125 and door 115 without use of a battery within a wireless sensor.

Preferably, but not required for operation of the RPAM, the wireless window sensor 120 and the wireless door sensor 110 include a wireless sensor capacitor 340 for energy storage to activate the optional wireless sensor transmitter 350 to signal an alert during a period of time when the wireless window sensor 120 and the wireless door sensor 110 are not polled by the wireless local interface 160. The capacitor 340 is energized preferably during the polling of the wireless window sensor 120 and the wireless door sensor 110, although the capacitor 340 can be energized with a separate signal from the wireless local interface 160 or any other local devices.

Figure 4:
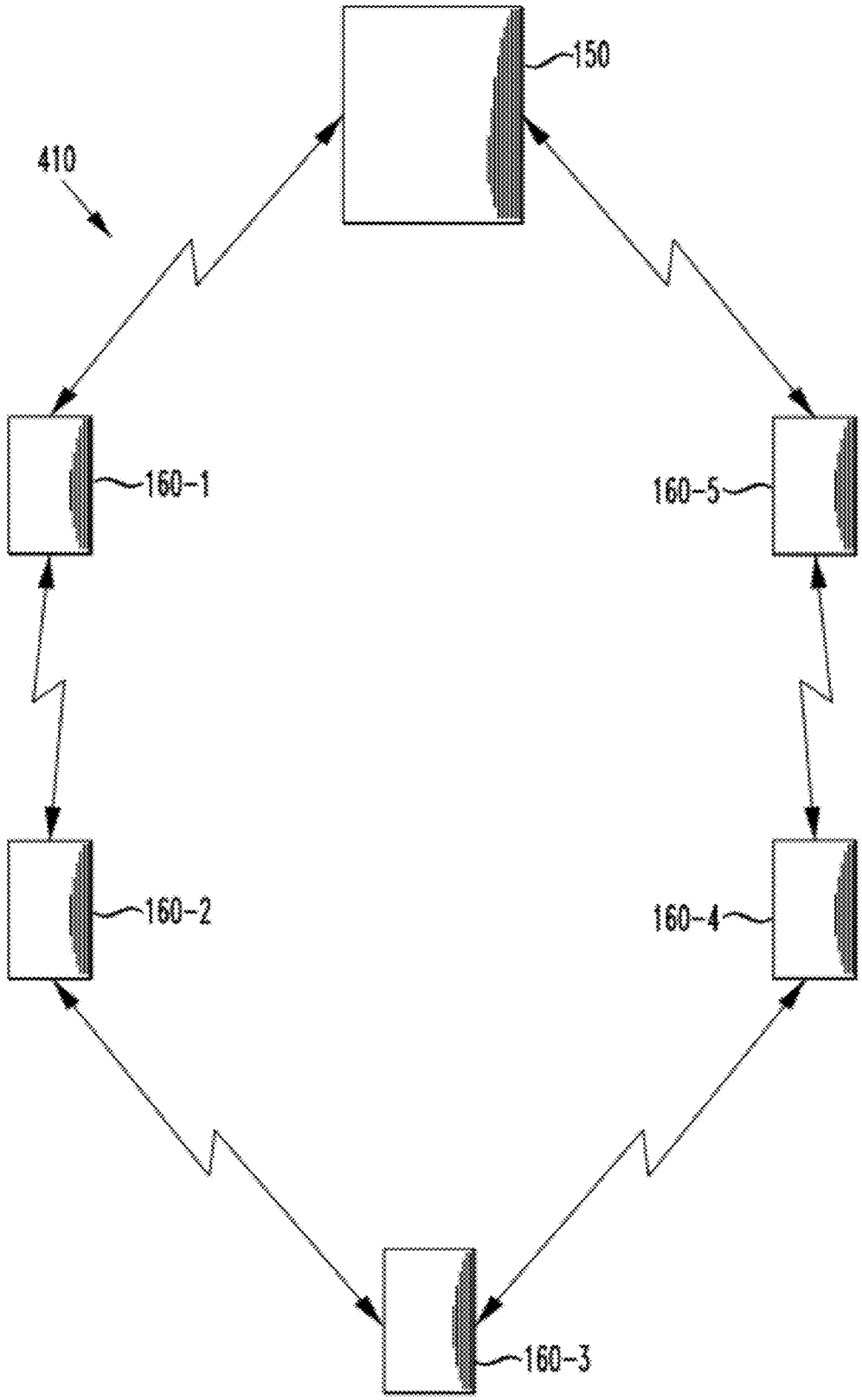
FIG. 4 shows an alternate embodiment utilizing a security network formed from a plurality of wireless local interfaces communicating with a remote user panel.

FIG. 4 shows a security network formed from a plurality of wireless local interfaces for communication with a remote user panel.

In particular, the security network 410 is comprised of the remote user panel 150, a first wireless local interface 160-1, a second wireless local interface 160-2, a third wireless local interface 160-3, a fourth wireless local interface 160-4 and a fifth wireless local interface 160-5.

In many large premises the distance between the remote user panel 150 and the farthest window 125 or door 115 being monitored is greater than an allowable transmission strength under Federal Communications Commission (FCC) regulations for communications there between. Thus, for wireless transmissions, a signal strength of a wireless local interface must be below that required for registration with the FCC. However, communications using low signal strengths between a farthest wireless local interface 160 and remote user panel 150 can be facilitated through a security network 410, as discussed below.

To allow a remote user panel 150 to communicate with a farthest wireless local interface 160 within a large premises, a security network 410 is formed between the first wireless local interface 160-1, the second wireless local interface 160-2, the third wireless local interface 160-3, the fourth wireless local interface 160-4 and the fifth wireless local interface 160-5. In this manner, the remote user panel 150 is able to indirectly communicate with farthest wireless local interface 160-3 indirectly through any one of the first wireless local interface 160-1, the second wireless local interface 160-2, the fourth wireless local interface 160-4 and the fifth wireless local interface 160-5. An indication of an intruder can be passed between any of the components within the security network 410, communications only being limited by the ability to establish communications between the various components.

Existing wireless networking protocols to establish a security network 140 between the first wireless local interface 160-1, the second wireless local interface 160-2, the third wireless local interface 160-3, the fourth wireless local interface 160-4 and the fifth wireless local interface 160-5 include Bluetooth™, HomeRF, WiFi, etc. However, since the wireless local interfaces 160 are connected to a wall power outlet and/or a telephone line outlet, wired networking protocols can be used to establish a security network 410. Wired network protocols include X10 power line communications, HomePlug™, HomePNA, etc. Therefore, the area covered by the RPAM 101 is only limited by the number of wireless local interfaces 160 used to create the security network 410 and not by the size of the premises being monitored by the RPAM 101.

In the example of a BLUETOOTH piconet, the current standards permit one (1) master and seven (7) slaves to be active in the piconet at any one time. In accordance with the principles of the present invention, after a wireless local interface 160 enters the piconet wireless network as a slave and communicates with an appropriate master wireless local interface 160 and/or a remote user panel 150, that wireless local interfaces 160 may then be placed into a 'park' mode. In this way, many more than seven (7) wireless local interfaces 160 may be utilized at any one time. Of course, multiple masters will also permit an increase in the number of wireless local interfaces 160 which may be used in a particular system, with the multiple masters being connected to form a scatternet.

Although five wireless local interfaces and a single remote user panel are shown in FIG. 4, any number of wireless local interfaces and remote user panels can be used with the invention. The actual number of wireless local interfaces and remote user panels is only dependent on the number desired/required by a user for a particular application.

Figure 5:
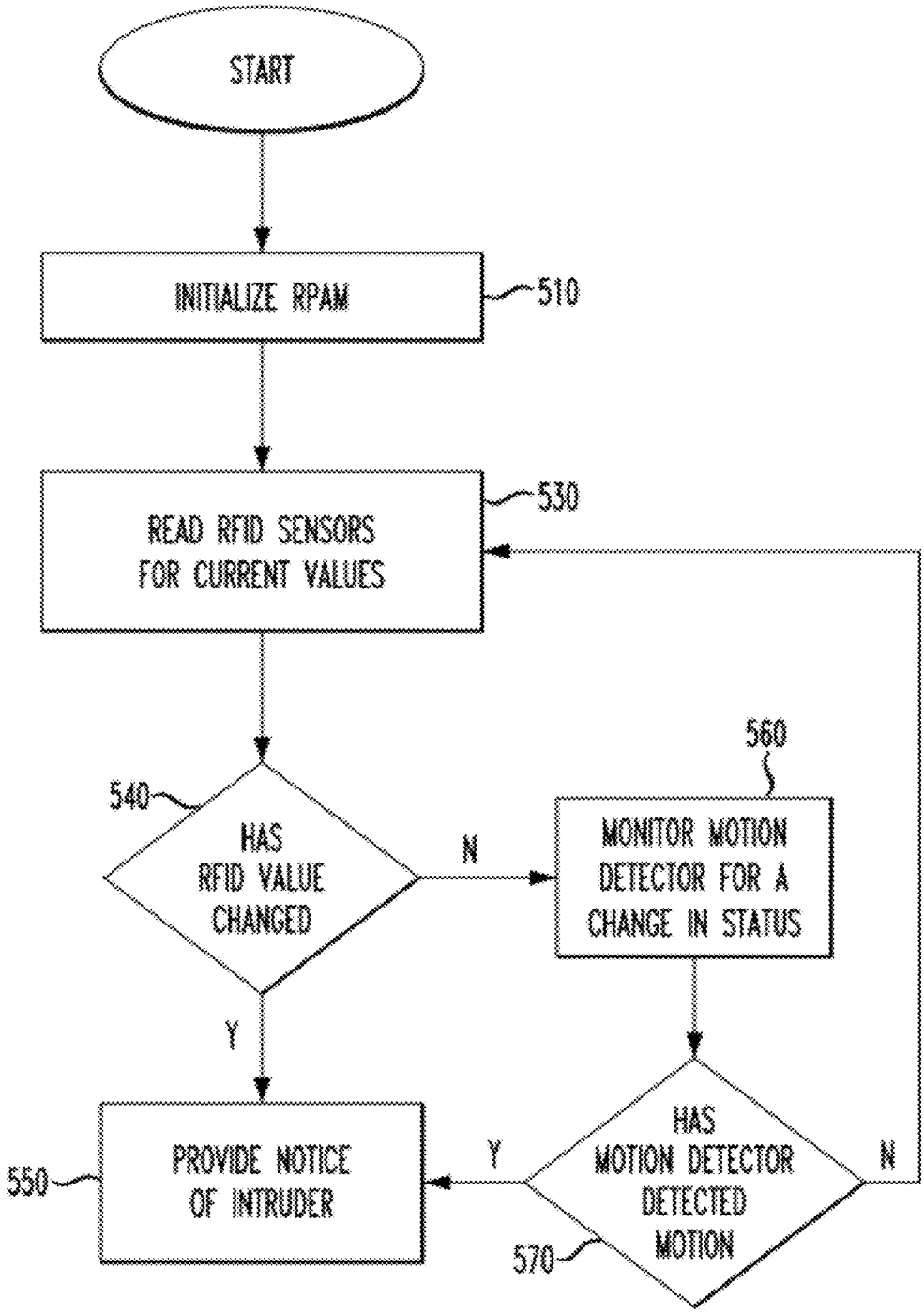
FIG. 5 shows a process by which a wireless security system in accordance with principles of the present invention monitors for an intruder.
Figure 6:
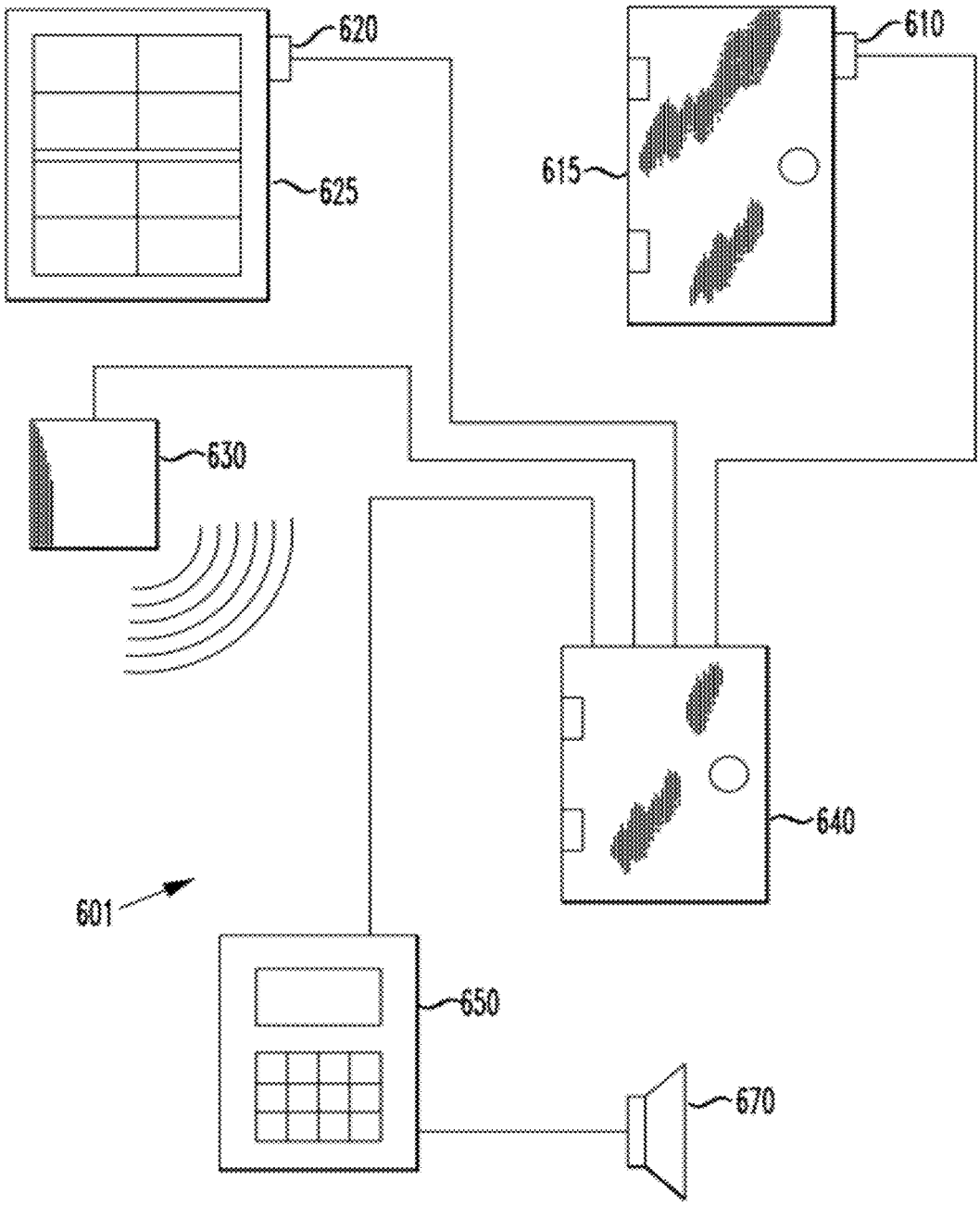
FIG. 6 (PRIOR ART)
FIG. 6 shows a conventional wired security system.
Figure 7:
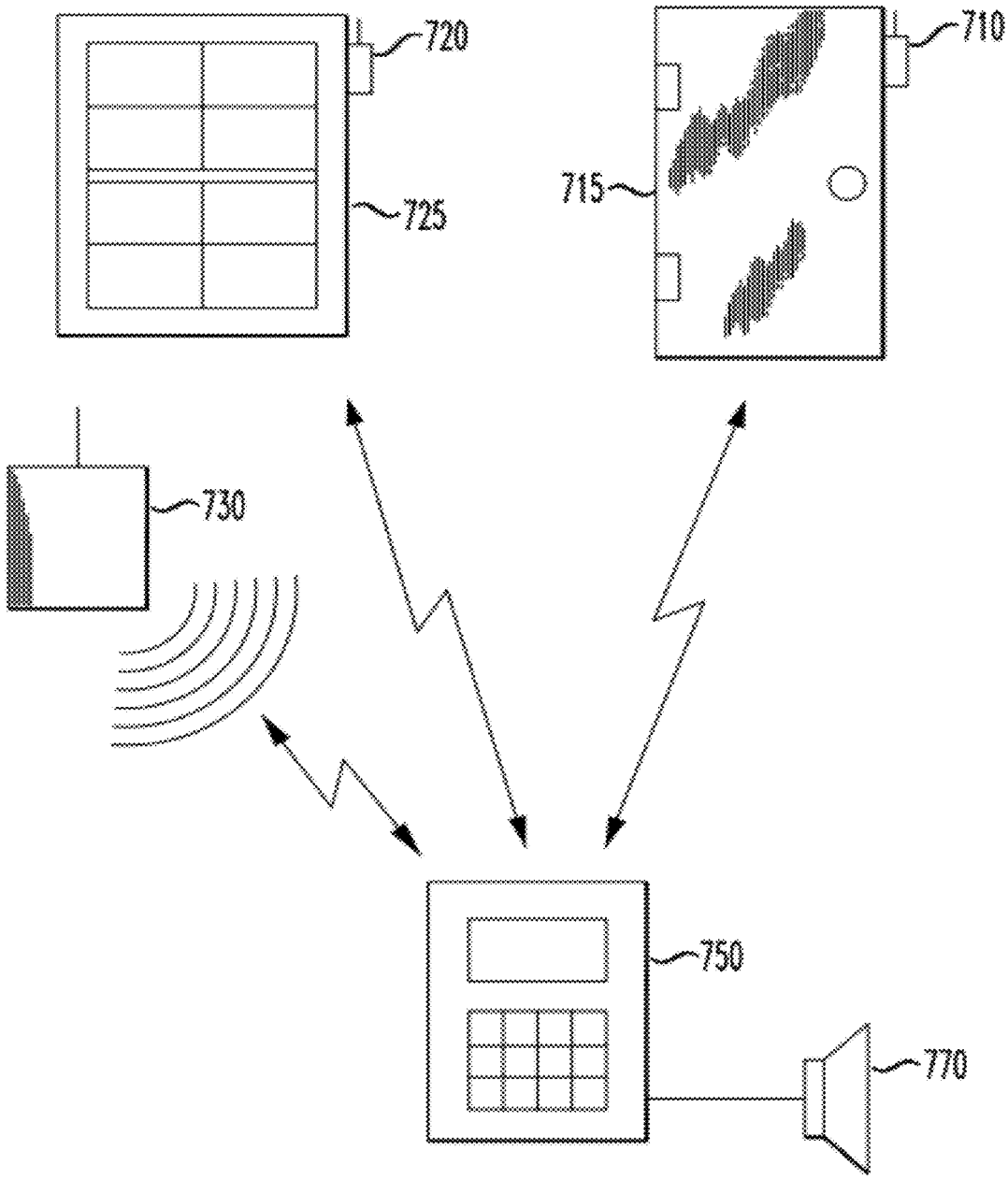
FIG. 7 (PRIOR ART)
FIG. 7 shows a conventional wireless security system.

FIG. 5 shows a process by which a wireless security system in accordance with principles of the present invention monitors for an intruder, as shown in FIGS. 1 and 4.

In step 510, the RPAM 101 is initialized. With all of the doors and windows within a premises closed, a menu option is selected on the remote user panel 150 to initialize the RPAM 101 to establish baseline values for all of the wireless door sensors 110 and wireless window sensors 120 within the system, i.e., values from the various wireless door sensors 110 and wireless window sensors 120 are read by the wireless local interface 160 in the closed position.

In step 530, when the RPAM 101 is activated for monitoring a premises, the current values of the various wireless door sensors 110 and wireless window sensors 120 are read by the wireless local interface 160, and relayed to the remote user panel 150.

In step 540, the baseline values for the wireless door sensor 110 and wireless window sensor 120 within the system are compared to current values of the wireless door sensor 110 and wireless window sensor 120 read in step 530 for a determination of an intruder. Step 540 conditionally branches based on an outcome of the comparison, i.e., branches to step 560 if the baseline values are the same as the current wireless sensor values and branches to step 550 if the baseline values are different than the current wireless sensor values.

In step 550, a notice is provided of an intruder through speaker 170 based on the determination that the baseline values are different than the current wireless sensor values in step 540.

In step 560, optional motion detector 270 is monitored for a determination of motion within a field of view of wireless local interface 160.

In step 570, a determination is made if motion detector 270 has detected motion. If the motion detector 270 detects motion within a field of view of wireless local interface 160, step 570 conditionally branches based on detected motion, i.e., branches to step 530 if no motion is detected and branches to step 550 if motion is detected. If motion is detected, step 550 provides notice of an intruder through speaker 170. If motion is not detected, step 530 starts the process anew to determine if an intruder has entered a premises being monitored by RPAM 101.

While the invention has been shown and described with reference to the provision of a security system relying on RFID technology, the principles disclosed herein relate equally to use of any passive security sensors that lack a power source and are wirelessly remotely polled for a determination of an intrusion within a premises.

While the invention has been shown and described with reference to a security system incorporating the novel features described herein, a conventional wired and conventional wireless security system can be retrofitted with the components described. Retrofitting a conventional wired and conventional wireless security system eliminates some of the costs associated with having to buy a new remote user panel and speaker. An emulation security module would emulate components within a conventional wired and conventional wireless security system to allow existing components to communicate within the novel components described herein.

While the invention has been described with reference to the exemplary embodiments thereof, those skilled in the art will be able to make various modifications to the described embodiments of the invention without departing from the true spirit and scope of the invention.

What is claimed is:

1. A security system, comprising:

a switch sensor to detect a condition of an access point to a building; and a Radio Frequency Identification (RFID) tag to formulate an RFID tag message to wirelessly communicate with a remote RFID tag reader;

wherein said switch sensor directly modifies a binary value stored by said RFID tag in response to said detected condition, said binary value being wirelessly transmitted with said RFID tag message.

2. The security system according to claim 1, wherein:

said remote RFID tag reader is comprised of a motion detector to detect motion within a field of view of said remote RFID tag reader.

3. The security system according to claim 1, further comprising:

a capacitor connected to said RFID tag to power an alert to signal a change in status of said RFID tag during a period of time when said RFID tag is not wirelessly interfaced.

4. The security system according to claim 1, further comprising:

a security network transceiver integrated with said remote RFID tag reader to communicate with at least one of a second remote RFID tag reader and a remote user panel.

5. The security system according to claim 4, wherein:

said security network transceiver is a Bluetooth™ transceiver.

6. The security system according to claim 1, wherein:

said remote RFID tag reader plugs into a wall power outlet.

7. The security system according to claim 1, wherein:

said remote RFID tag reader is integrated with a wall power outlet.

8. The security system according to claim 1, wherein:

said remote RFID tag reader relays said binary value associated with said condition to a remote user panel.

9. The security system according to claim 1, wherein:

said remote RFID tag reader communicates with a remote user panel.

10. The security system according to claim 9, wherein:

said remote user panel is connected to a speaker to sound an alert upon detection of an intruder.

11. The security system according to claim 1, wherein:

said condition is an open/close condition.

12. The security system according to claim 1, wherein:

said condition is a locked/unlocked condition.

13. The security system according to claim 1, wherein:

said RFID tag is embedded in a lock mechanism to continuously monitor a locked/unlocked condition of said lock.

14. A method of surveying access points to a building, said method comprising:

detecting a condition of an access point to said building with a switch sensor device;

directly modifying, with said switch sensor device, a binary value stored by a Radio Frequency Identification (RFID) tag in response to said detected condition;

formulating an RFID tag message with said RFID tag to wirelessly transmit said binary value to a remote RFID tag reader; and wirelessly interfacing said RFID tag with said remote RFID reader to transmit said stored binary value associated with said detected condition.

15. The method of surveying access points to a building according to claim 14, further comprising:

detecting motion within a field of view of said remote RFID tag reader.

16. The method of surveying access points to a building according to claim 14, further comprising:

communicating with a second remote RFID tag reader.

17. The method of surveying access points to a building according to claim 14, wherein:

said condition is an open/close condition.

18. The method of surveying access points to a building according to claim 14, wherein:

said condition is a locked/unlocked condition.

19. The method of surveying access points to a building according to claim 14, further comprising:

embedding said RFID tag in a lock mechanism to continuously monitor a locked/unlocked condition of said lock.

20. A wireless security sensor, comprising:

a switch sensor to detect a condition of an entry point to a building; and a Radio Frequency Identification (RFID) tag to formulate an RFID tag message, said RFID tag message being wirelessly transmitted to a remote RFID tag reader;

wherein said switch sensor modifies a binary value stored by said RFID tag in response to said detected condition, said binary value being wirelessly transmitted with said RFID tag message; and wherein said wireless security sensor lacks a local power storage.

21. The wireless security sensor according to claim 20, wherein:

said condition is a locked/unlocked condition.

22. The wireless security sensor according to claim 20, wherein:

said RFID tag is embedded in a lock to continuously monitor a locked/unlocked condition of said lock.

23. A method of sensing a security condition, comprising:

detecting a condition of an entry point to a building with a switch sensor;

modifying a binary value stored by a Radio Frequency Identification (RFID) tag in response to said detected condition, said RFID tag lacking a local power storage; and formulating an RFID tag message to wirelessly transmit said stored binary value to a remote RFID tag reader.

24. The method according to claim 23, wherein:

said condition is a locked/unlocked condition.

25. The method according to claim 23, wherein:

said passive sensor is embedded in a lock mechanism to continuously monitor a locked/unlocked condition of said lock.

* * * * *